US006189283B1

(12) United States Patent
Bentley et al.

(10) Patent No.: US 6,189,283 B1
(45) **Date of Patent: *Feb. 20, 2001**

(54) PORTABLE FLOOR

(75) Inventors: Michael John Bentley; Adrian Allen Ronald Clover; Antony John Richard Pepper, all of Kent (GB)

(73) Assignee: Sico Incorporated, Minneapolis, MN (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/077,512

(22) PCT Filed: Dec. 5, 1996

(86) PCT No.: PCT/US96/19282

§ 371 Date: Jan. 11, 1999

§ 102(e) Date: Jan. 11, 1999

(87) PCT Pub. No.: WO97/21011

PCT Pub. Date: Jun. 12, 1997

(30) Foreign Application Priority Data

| | | |
|---|---|---|
| Dec. 5, 1995 | (GB) | 9524822 |
| Feb. 21, 1996 | (GB) | 9603642 |
| Nov. 29, 1996 | (GB) | 9624901 |

(51) Int. Cl.[7] ..... E04F 15/024

(52) U.S. Cl. ..... 52/587.1; 52/457; 52/458; 52/585.1; 52/718.01; 52/745.13; 52/747.1; 52/747.11

(58) Field of Search ..... 52/480, 457, 458, 52/587.1, 585.1, 718.01, 211, 747.1, 747.11, 745.13

(56) References Cited

U.S. PATENT DOCUMENTS

| | | |
|---|---|---|
| 369,478 | 9/1887 | Snow . |
| 876,912 | 1/1908 | Pike . |
| 1,175,316 | 3/1916 | Solon . |

(List continued on next page.)

FOREIGN PATENT DOCUMENTS

| | | |
|---|---|---|
| 486349 | 8/1977 | (AU) . |
| 512 697 | 9/1971 | (CH) . |
| 2 145 024 | 3/1973 | (DE) . |
| 2 248 892 | 4/1974 | (DE) . |
| 24 48 880 | 4/1976 | (DE) . |
| 0 117 707 | 9/1984 | (EP) . |
| 0 171 324 | 2/1986 | (EP) . |
| 1 347 862 | 11/1963 | (FR) . |
| 2 445 461 | 12/1978 | (FR) . |

OTHER PUBLICATIONS

"Sico® The Original Portable Dance Floor", Sico Incorporated, ©1990 (brochure and price list, 6 pgs.).

*Primary Examiner*—Christopher T. Kent
(74) *Attorney, Agent, or Firm*—Merchant & Gould P.C.

(57) ABSTRACT

A portable floor system (20) including individual floor sections (22, 24) joined by interlocking tongue elements (40) and receiver elements (50, 70). Each floor section (22, 24) is substantially planar and rectangular, and includes tongue elements on two sides and receiver elements on two sides. The tongue elements (40) have an upwardly-turned portion (44) which engages a downwardly projecting inner member (58, 78) of the receiver elements (50, 70). The receiver elements include a first embodiment (50) having an opening (56) which can be entered by a tongue element from the side of the panel, and a second embodiment (70) having an opening (76) which can be entered by a tongue element from either the side or the bottom of the panel. The portable floor system further includes edge sections (26, 28) which create a smooth transition from the portable floor sections to the permanent floor surface.

19 Claims, 10 Drawing Sheets

U.S. PATENT DOCUMENTS

| | | | | |
|---|---|---|---|---|
| 1,894,584 | | 1/1933 | Fort . | |
| 2,021,922 | | 11/1935 | Peck . | |
| 2,115,936 | | 5/1938 | Sterns . | |
| 2,142,305 | | 1/1939 | Davis . | |
| 2,217,781 | | 10/1940 | Wiley . | |
| 2,377,211 | | 5/1945 | Cocken, Jr. . | |
| 2,490,577 | | 12/1949 | Brown . | |
| 2,666,508 | | 1/1954 | Nardulli . | |
| 2,822,585 | | 2/1958 | Baruch . | |
| 3,141,392 | | 7/1964 | Schneider et al. . | |
| 3,191,726 | | 6/1965 | Pavlecka . | |
| 3,239,986 | | 3/1966 | Russell . | |
| 3,248,995 | | 5/1966 | Meyer . | |
| 3,310,919 | | 3/1967 | Bue et al. . | |
| 3,385,183 | | 5/1968 | Kortz . | |
| 3,400,958 | | 9/1968 | Haimes et al. . | |
| 3,500,606 | | 3/1970 | Wharmby . | |
| 3,512,324 | * | 5/1970 | Reed | 52/585 |
| 3,567,260 | | 3/1971 | Norris . | |
| 3,599,385 | | 8/1971 | LaRue . | |
| 3,826,056 | | 7/1974 | Smith et al. . | |
| 3,890,753 | | 6/1975 | Johansen . | |
| 4,045,927 | | 9/1977 | Diaz . | |
| 4,057,948 | | 11/1977 | Wise . | |
| 4,144,681 | | 3/1979 | Leffler et al. . | |
| 4,205,470 | | 6/1980 | Kapnek . | |
| 4,411,118 | | 10/1983 | Claver . | |
| 4,465,398 | | 8/1984 | Knudsen . | |
| 4,538,392 | | 9/1985 | Hamar et al. . | |
| 4,893,449 | | 1/1990 | Kemper . | |
| 5,022,200 | | 6/1991 | Wilson et al. . | |
| 5,070,662 | | 12/1991 | Niese . | |
| 5,155,960 | | 10/1992 | Shaanan . | |
| 5,157,890 | | 10/1992 | Jines . | |
| 5,403,637 | | 4/1995 | Pickard et al. . | |
| 5,483,779 | | 1/1996 | Crawford et al. . | |
| 5,579,621 | | 12/1996 | Fang . | |
| 5,634,309 | | 6/1997 | Polen . | |
| 5,865,004 | | 2/1999 | Mitchell . | |

* cited by examiner

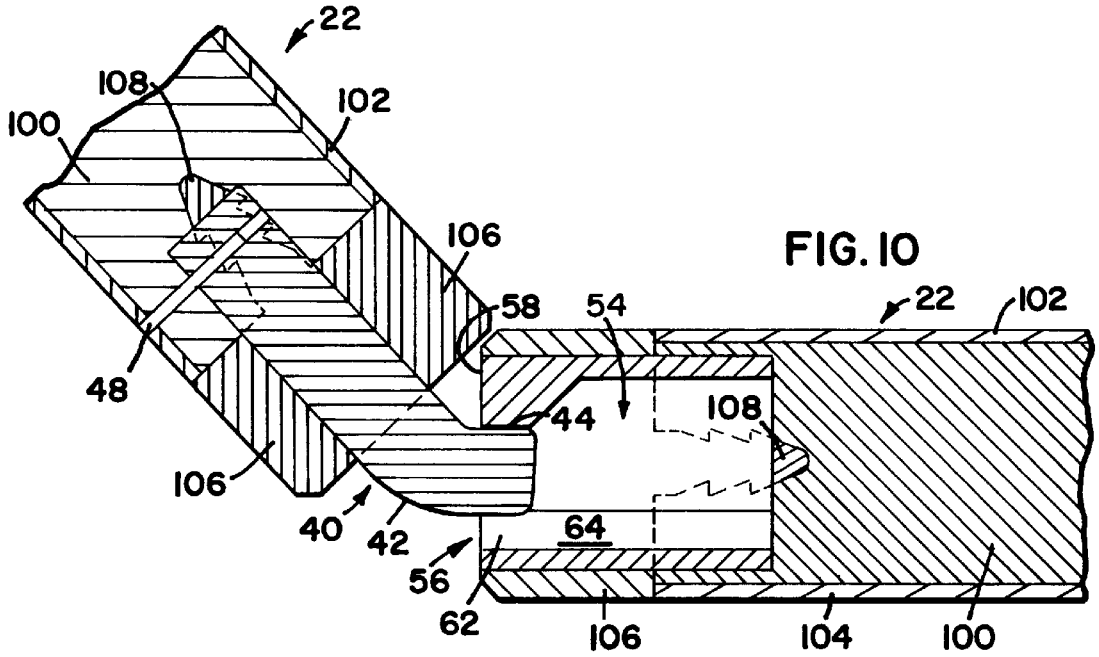
FIG. 10
FIG. 11
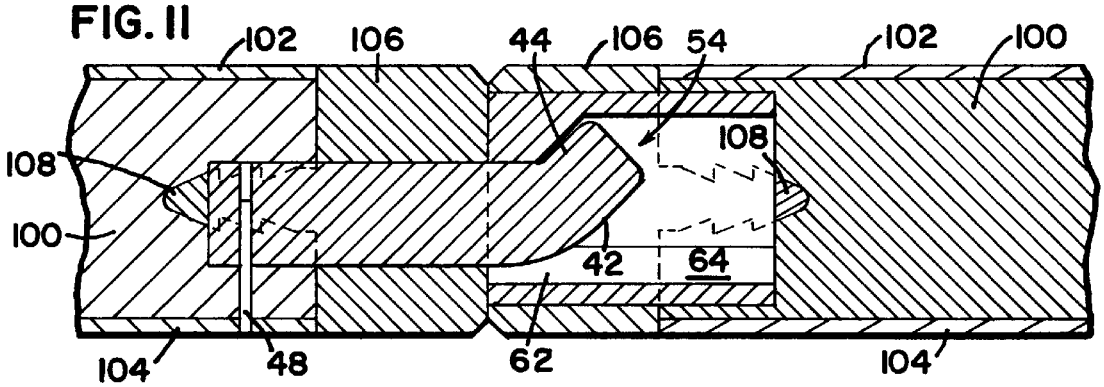
FIG. 12
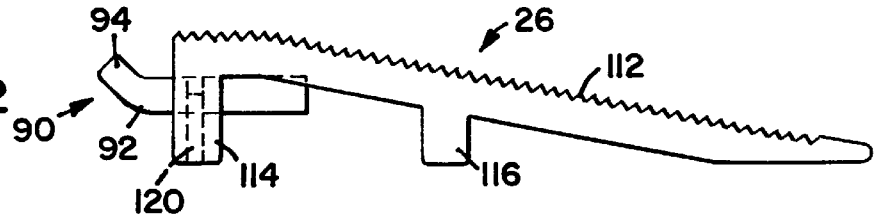
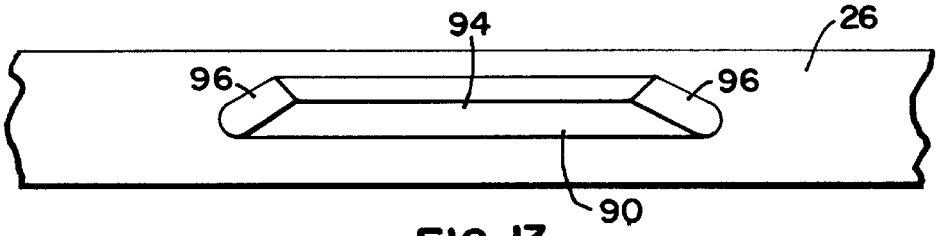
FIG. 13

FIG. 20
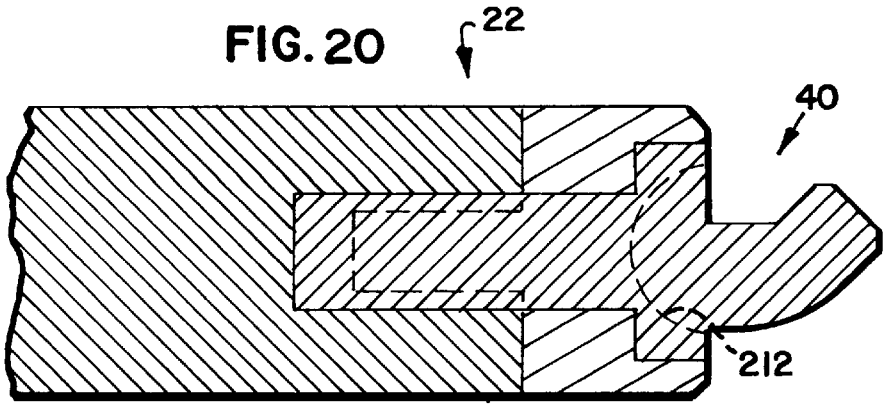
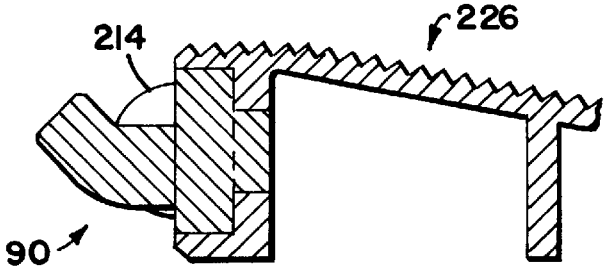
FIG. 21
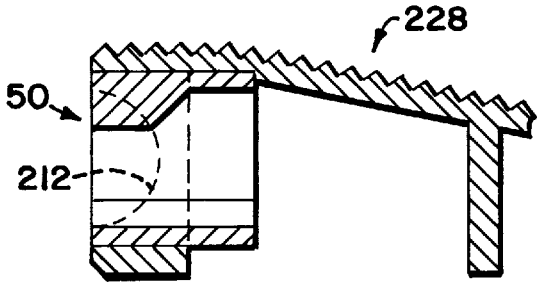
FIG. 22
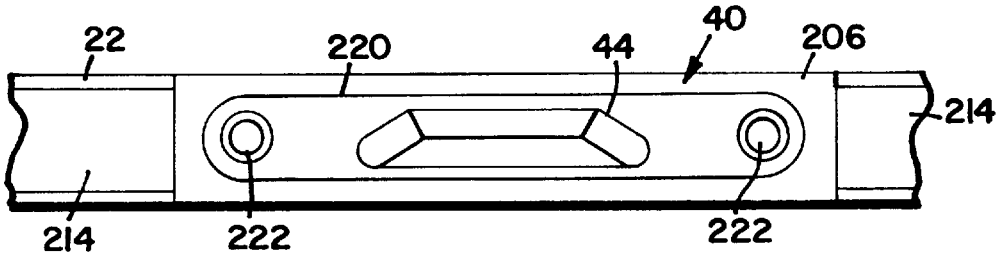
FIG. 23

PORTABLE FLOOR

BACKGROUND OF THE INVENTION

1. Field of the Invention

The present invention relates to a floor system, and in particular, to a portable floor system which is quickly assembled and disassembled.

2. Description of the Prior Art

A long-standing need exists for a portable floor system that may be quickly and easily assembled and disassembled over an existing floor. This is particularly true in locations which are used for multiple purposes requiring different types of floors. For example, many hotels, recreation centers, banquet halls, and conference centers desire a carpet or tile floor covering for most of their uses, but also hold occasional dances requiring a hard, smooth, wood-like surface. These facilities, and others like them, require an interchangeable floor system that can be switched between different surfaces, depending upon varying needs.

It is necessary that a portable floor be easy and quick to install, provide a secure and level dance surface, and be able to withstand the exertion of substantial forces from people walking or dancing on it. The sections comprising the portable floor will also be preferably joined such that the method of joining leaves no joining apparatus visible from the exterior in the assembled floor. Thus, it is preferred that no external screws, bolts or other fasteners be used. The absence of such parts is preferred on both aesthetic and functional grounds, as the dance floor will appear to be more permanent and attractive if no exposed fasteners are evident, and there is less likelihood of injury from tripping or stumbling over exposed or loosened parts.

It is also preferred that the dance floor be quickly and easily installed and removed, as well as being easily portable. Therefore, the floor should be able to be installed with minimal parts and labor. On disassembly, the resulting floor sections should be compact and lightweight such that they may easily be transported and stored.

A further preferred feature is that the dance floor be constructed in a manner and using materials which may withstand the rigorous wear and tear of frequent use. Also, the portable floor should include sloping edge trim to merge as smoothly as possible with the underlying surrounding permanent floor surface, which is often a carpeted area.

In order to address this need for interchangeable floors, various portable floor systems have been developed, most designed to create a surface suitable for dancing over an underlying surface unsuitable for dancing. A number of different designs have been proposed and produced. Typically, these portable floors have included individual panels joined in one manner or another along their edges. These joining methods have included bolts, screws, tongue-and-groove joints cut running along the panel sides, and various interlocking sections which require tools for assembly and disassembly. However, most of these dance floors exhibit significant disadvantages in use, construction and installation.

United Kingdom Patent Application GB 2161514A, issued to Cova, provides a dance floor joined by an interlocking lattice network and beams extending from the edge of each separate floor panel. This design has a number of drawbacks, including projecting edges along the sides of the dance floor, a complicated and expensive construction, and a relatively thick cross section.

Other prior portable dance floors include panels which simply fold up rather than disengage from one another. A typical example of such a floor is disclosed in U.S. Pat. No. 5,033,241, issued to Max. This form of dance floor has the significant drawback of being limited to a size which can easily fold and be carried as one piece. Therefore, only extremely small dance floors may be created. Other inventors have attempted to use interlocking sides, often with some sort of "tongue and groove" joining method. However, those designs using tongue and groove joints have had draw backs, including difficulty in assembly and disassembly, and sliding of pieces with respect to one another along their edges. These floors also require complementary lock devices which add to the complexity and cost of manufacture and require additional set up and take down time. In addition, these lock devices may often disengage or malfunction, resulting in floor sections coming apart and an unsafe floor.

It can be seen then, that a new and improved portable floor is needed which is durable and lightweight. In addition, such a floor should provide for secure attachment of adjacent floor sections without requiring complicated locking mechanisms. Such a floor should also be easy to assemble and disassemble with a smooth transition to the underlying surface. The present invention addresses these as well as other problems associated with portable floor systems.

SUMMARY OF THE INVENTION

The present invention is directed to a portable floor system which may be used to provide a second floor surface wherever multiple uses necessitate having more than one type of floor surface. Most frequently, the portable floor system will be used to create a temporary dance floor in a place where a permanent dance floor is not desired. Such places include hotels, convention centers, schools, reception halls, and clubs.

The portable floor system may be quickly assembled and disassembled from individual floor sections which are easily transported and stored. The individual floor sections of the present invention are joined by interlocking tongue elements from one panel, with complementary receiver elements from a second panel. These tongue and groove elements are designed in a manner that the floor sections may be quickly connected and disconnected, while at the same time providing a very secure and stable dance floor which is smooth, level and suitable for walking and dancing upon. The floor sections are retained such that they are substantially free from transverse and vertical motion relative to each other.

Each floor section includes tongue elements on two sides, and receiver elements on two sides. The tongue elements of one section engage the complementary groove-type receiver elements on sides of adjacent sections. Each section has at least two tongue elements and two receiver elements disposed around its perimeter. The tongue elements project from the side of the floor section and include an upwardly bent portion at their outer end. This upwardly bent portion engages a corresponding portion of the receiver element which extends downward into a recess of the receiver element.

The receiver elements are formed in two different configurations: First, a configuration in which the receiver element is open for receiving the tongue element on both the bottom and the side of the panel, and second, a configuration in which the receiver element is open for receiving the tongue element from only the side of the panel. These different configurations of receiver elements are placed on adjacent sides of the individual panels, and permit joining of the panels in one of two methods: sliding the tongue element into the side of a receiver element, or for receiver elements having access through a bottom opening, lowering the receiver element onto the top of a tongue element.

The two configurations of receiver elements permit an easy joining of numerous panels to form the completed floor. When joining adjacent panels, the tongue element of a first panel is inserted into the side opening of receiver elements of a second panel. Next, additional receiver elements having bottom access on the second panel are lowered onto tongue elements of a third panel.

In addition, the portable floor system includes edge sections which create a smooth transition from the portable floor panels to the permanent floor surface. These edge sections also join to the floor panels by tongue elements and receiver elements. The tongue elements of the edge sections are broader and thinner than the tongue elements of the portable floor panels, which permits them to be supported by restricting portions extending into the opening of the receiver elements.

According to a second embodiment of the present invention, at least one side of the panels includes a convex profile with a horizontally extending portion arcing outward from the side of the panel. At least one of the other sides of each panel includes a concave profile with a horizontally extending portion arcing inward from the side of the panel. The convex and concave portions are complementary and engage when the sides of the panels are attached. The convex and concave portions provide additional alignment and stability along the extended seams of the floor. The convex and concave profiles may also include horizontal grooves formed therein extending along a lower portion of the arcs. The edge trim panels include complementary concave and convex profiles with a complementary ridge extending from the profile which snaps into the groove.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding elements throughout the several views:

FIG. 10 shows a side cross-sectional view of a tongue element being tilted into engagement with the first complementary groove element;

FIG. 11 shows a side cross-sectional view of a tongue element in engagement with the first complementary groove element;

FIG. 12 shows an end elevational view of an edge trim member having a tongue connector element;

FIG. 13 shows a side elevational fragmentary view of a tongue connector element for the edge trim shown in FIG. 12;

FIG. 20 shows a side sectional view of the side of the floor panel shown in FIG. 14 with a concave side profile taken through a tongue element;

FIG. 21 shows an end detail sectional view of an edge trim panel having a convex profile and a tongue element for the portable floor apparatus shown in FIG. 16;

FIG. 22 shows an end detail sectional view of an edge trim panel having a concave profile and a groove element for the portable floor apparatus shown in FIG. 16;

FIG. 23 shows a side elevational view of the tongue connector element shown in FIG. 17;

DETAILED DESCRIPTION OF THE PREFERRED EMBODIMENT

Figure 1:
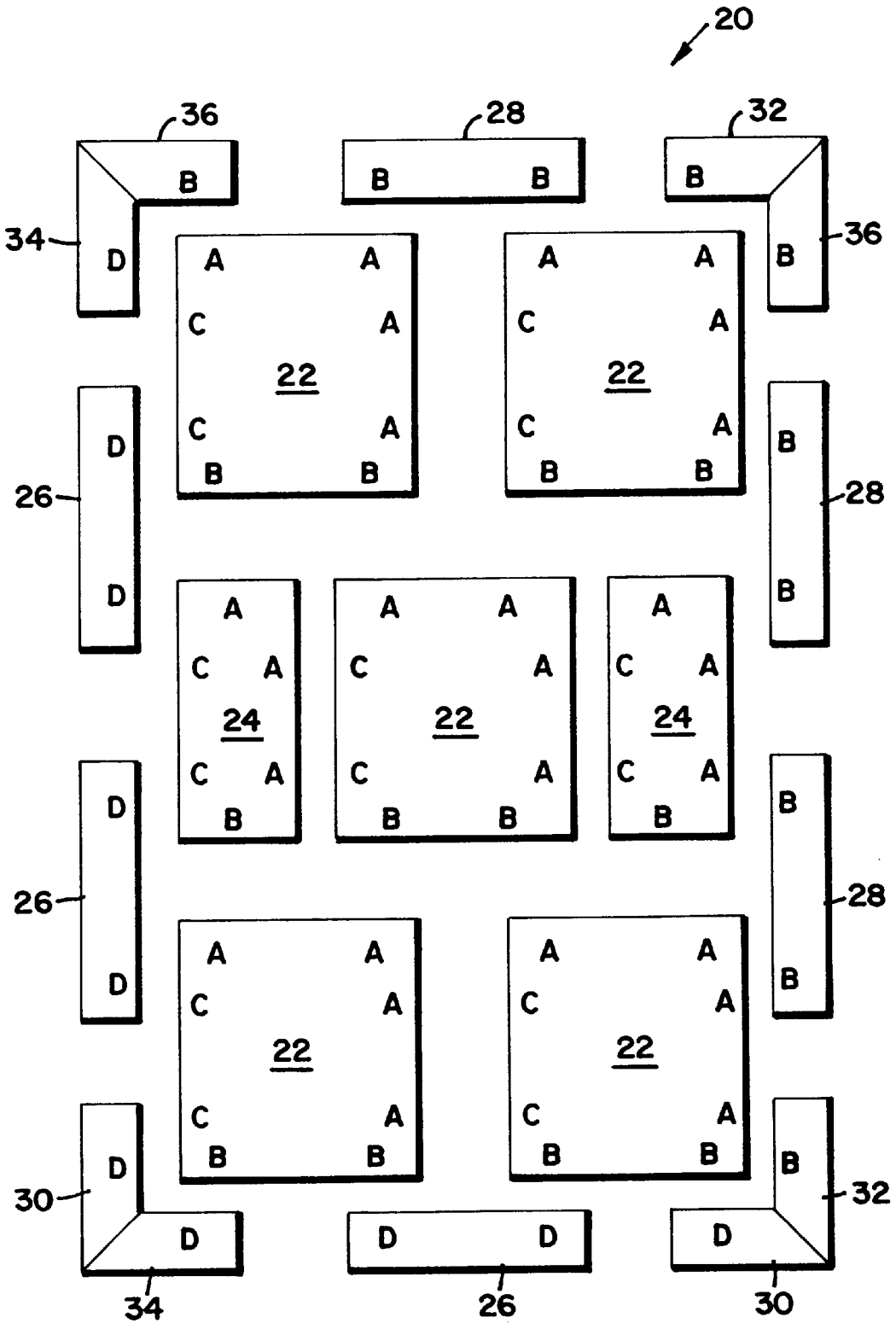
FIG. 1 shows a top plan diagrammatic view of a portable dance floor apparatus according to the principles of the present invention.

Referring now to the drawings, and in particular FIG. 1, there is shown a first embodiment of a portable floor system, generally designated 20. The portable floor system is typically used as a dance floor in hotels or other convention-type spaces where a dance floor may be needed only for some occasions and a permanent dance floor would limit the utility of the space. The dance floor 20 includes a number of panels 22 which are preferably rectangular or square panels. In a preferred embodiment, the panels 22 are square with a standard width, such as 1.2 meters or 4 feet. In order to improve alignment and for better attachment and connection, half-size panels 24 are placed in alternating rows so that the panels 22 are offset from one another from row to row to break up the continuous seams between panels. Although a floor 20 having only three rows of a width of two full-size panels is shown in FIG. 1, it can be appreciated that any larger size floor having a greater width and length may also be utilized using a greater number of panels. Edge trim sections 26 and 28 and edge trim comer sections 30, 32, 34 and 36 provide a gradual slope from the edge of the upper planar portable floor surface to the underlying floor. The resulting floor has an extended planar surface area with a gradual sloping edge to the underlying floor surface.

Figure 2:
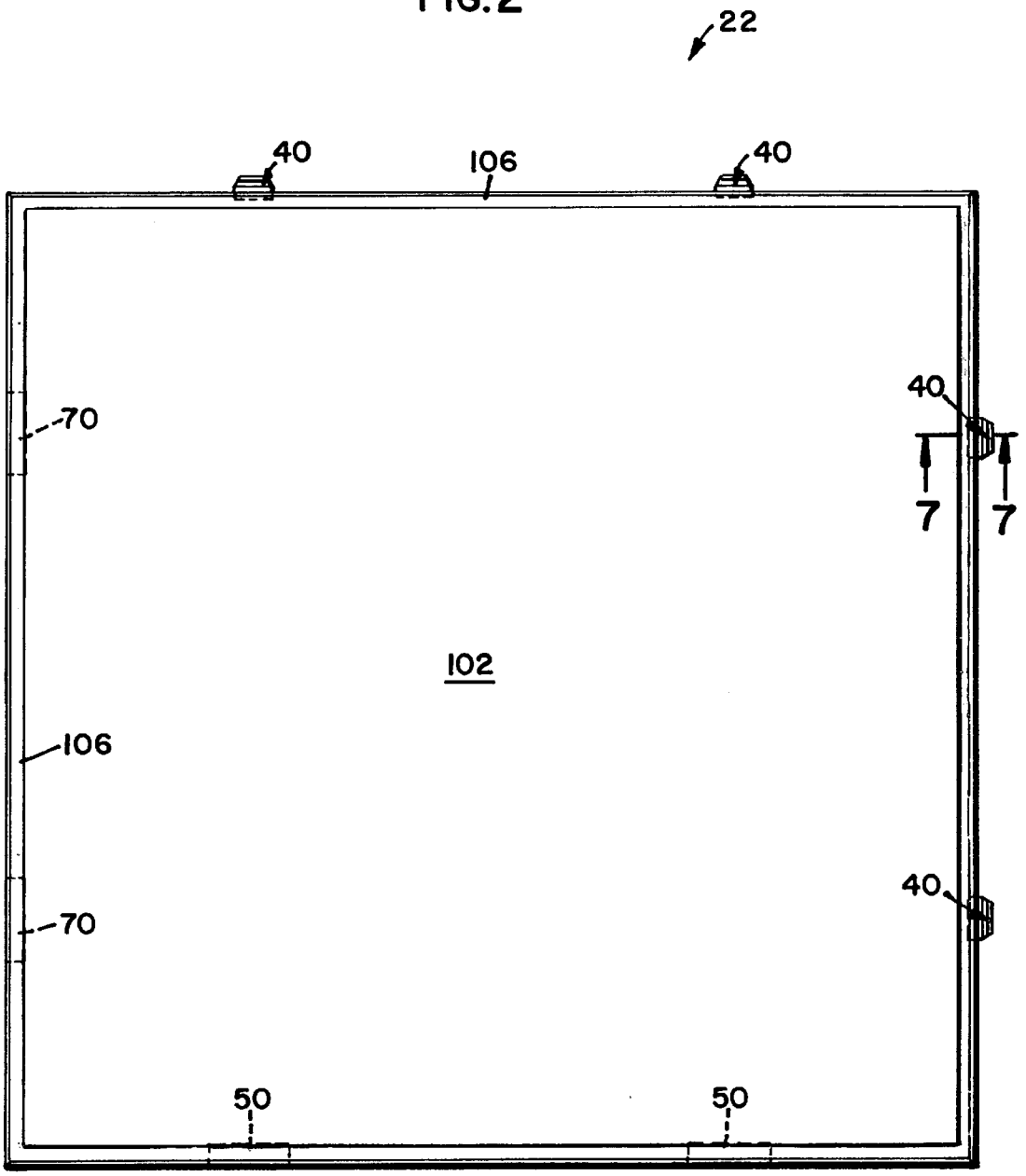
FIG. 2 shows a top plan view of a square floor panel for the floor system shown in FIG. 1.

Referring now to FIG. 2, there is shown individual floor panel 22. The floor panel 22 includes an upper facing 102 such as melamine or other durable surface material. In addition, edging material 106 extends around the periphery of each of the panels 22, and is attached as explained hereinafter. On two adjacent sides of the panel 22 are placed tongue-type elements 40. Tongue-type elements 40 extend from the side of the panel 22 and engage complementary groove type recesses on adjacent panels. The complementary groove-type retainer elements 50 and 70 are positioned on the other two sides of each floor panel 22. In the preferred embodiment, the full-size floor panels 22 are identical in order to provide for easier manufacture and layout. The complementary groove-type retainer elements 50 and 70 are configured for receiving the tongue elements 40 as well as tongue elements 90 from the edge trim panels 26 shown in FIGS. 12 and 13, as explained hereinafter.

Figure 3:
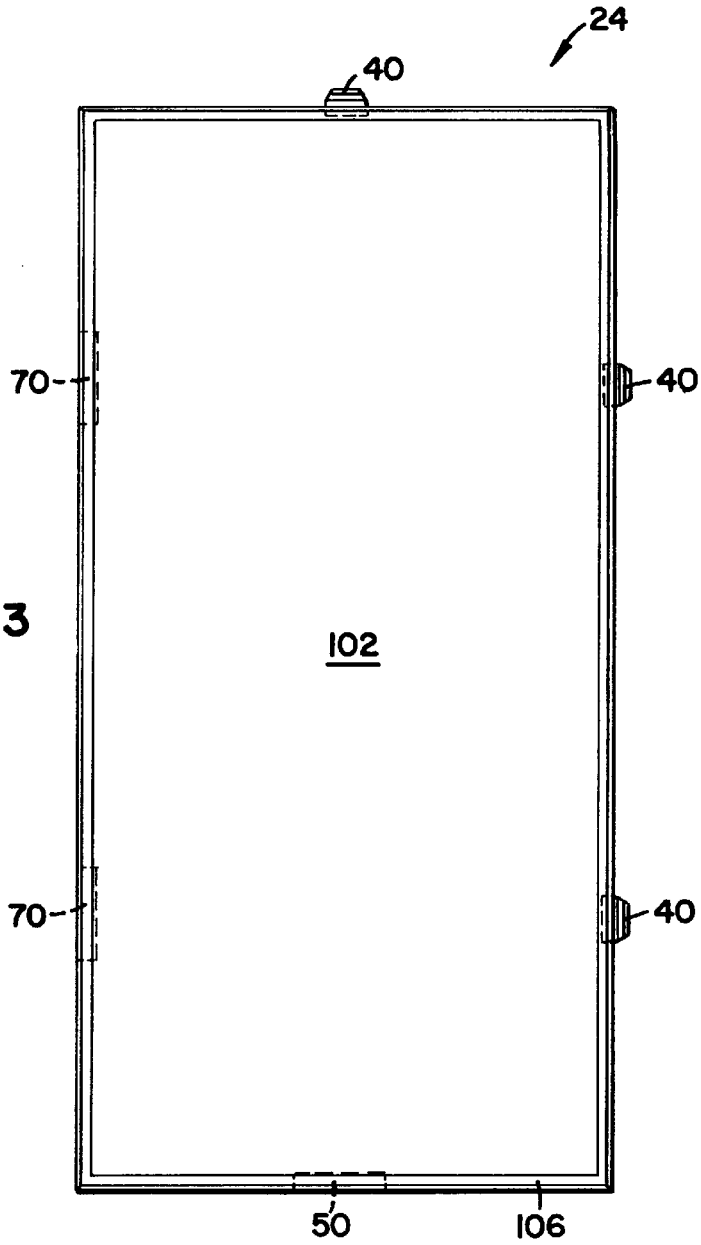
FIG. 3 shows a top plan view of a half size floor panel for the floor system shown in FIG. 1.

In a similar manner, as shown in FIG. 3, the half-size panel 24 includes tongue elements 40 on two adjacent sides with complementary groove-type recessed elements 50 and 70 along the other two sides. In the preferred embodiment, the half-size panels include a single tongue element 40 along the shorter side and a groove-type member 50 along the opposite side. Two tongue elements 40 are placed along one of the long sides while the two groove-type receiving elements 70 are placed along the opposite side, in the same orientation as in the full-size panels 22. In the preferred embodiment, the tongue elements 40 and groove elements 50 and 70 are placed one-quarter of the way along an edge of the panels 22 or long sides of the panels 24 or at the mid-point of the short side of a half-size panel 24. This provides for proper alignment between corresponding sides of the panels and equal spacing between connection points.

Figure 7:
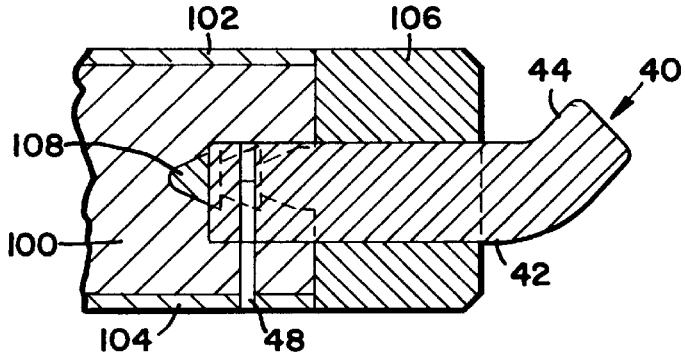
FIG. 7 shows a side sectional view of a tongue element for the floor shown in FIG. 1.

Referring to FIG. 7, in the preferred embodiment, the panel 22 includes a construction having a foam core 100 with an upper facing sheet 102 and a bottom support plate 104. Plastic or rubber edging 106 extends around the periphery of the core 100. The edging 106 includes a connective member 108 which is pushed into the foam core 100 and may also be adhesively attached and include barb members to resist removal. The tongue elements 40 insert through the edging 106 into the foam core 100 and may be adhesively attached and/or retained by pins or screws 48 extending upward through the bottom support layer 104. The layers 100, 102 and 104 are typically adhesively attached to form a panel member which then has the edging material 106 mounted thereto.

Figure 4:
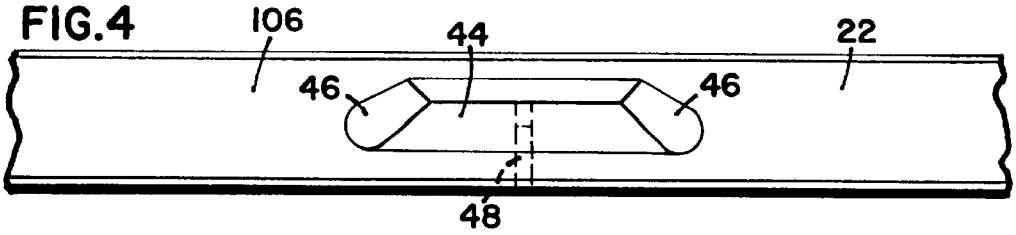
FIG. 4 shows a side elevational view of a tongue element for the floor section shown in FIG. 1.

Referring now to FIGS. 4 and 7, there is shown a tongue-type element 40 mounted along the side of panel 22. The tongue-type element 40 includes a lower horizontal portion 42 extending into the side of the panel 22. The tongue element 40 includes a substantially horizontal portion 42 extending inward to provide sufficient connection to the floor panel. The horizontal portion 42 extends outward slightly from the side of the floor panel through the edging material 106. An upward bending portion 44 extends at a substantially 45° angle from horizontal. A lip is formed on the upper surface thereof for engaging a retainer portion of the retainer elements, as explained hereinafter. As shown in FIG. 4, the tongue element 40 includes tapered sides 46 which provide for a degree of self-alignment during assembly as the tongue elements 40 insert into the complementary groove-type elements 50 and 70, and is radiused at the bottom to facilitate assembly.

Figure 5:
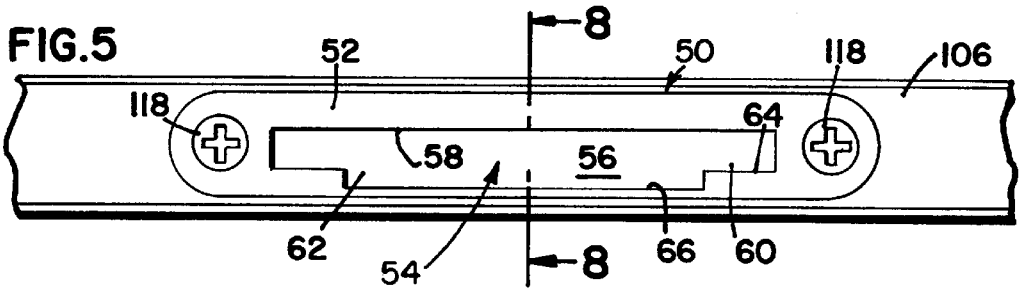
FIG. 5 shows a side elevational view of a first complementary groove element.
Figure 8:
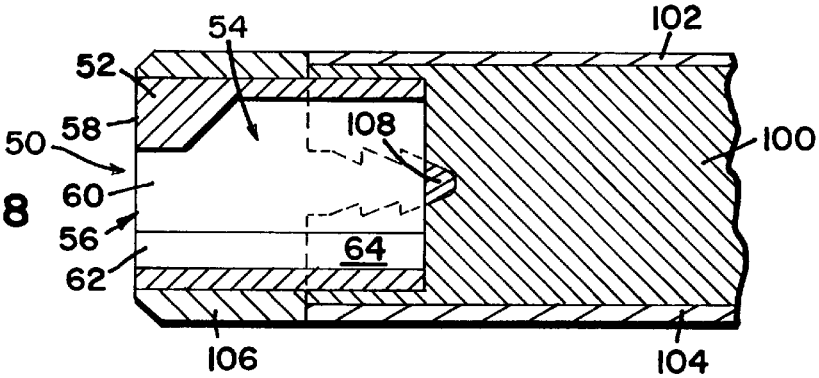
FIG. 8 shows a side sectional view of the first complementary groove element taken along line 8—8 in FIG. 5.

Referring now to FIGS. 5 and 8, there is shown a first groove-type element 50, which is complementary to and configured for receiving the tongue elements 40 and 90, as explained hereinafter. The first groove elements 50 include a plate member 52 which may be of a cast metal material or constructed of other durable material. The plate member 52 forms a recess 54 which is complementary to and configured for receiving the tongue elements 40 and 90. The recess 54 has an opening 56 at the front portion of the groove-type element 50 through which the tongue elements 40 and 90 are received. An upper retainer portion 58 extends downward at the outer side of the panel 22 and includes an angled inner surface. The upper retainer portion 58 is configured so that when the tongue element 40 is inserted into the recess 54, the upper portion 44 of the tongue element engages the rear angled portion of the retainer portion 58. As shown in FIG. 5, the orifice 56 includes an upper widened portion 60 and lower narrow portion 62. The widened portion 60 of the opening 56 is configured for receiving widened tongue elements 90 of the edge trim while the narrower lower portion 62 is configured for receiving the tongue elements 40 of the floor sections. Restricting portions 64 extend inward from the bottom of the orifice to form the narrow opening 62 and aid in guiding the tongue elements 40 into the orifice for proper alignment. The lower portion 62 of the orifice 56 is framed by a cross member 66 extending at an underside thereof to provide support below the tongue elements 40 when inserted. The first groove element 50 is mounted by screws 118 or other connecting methods well known in the art.

Figure 6:
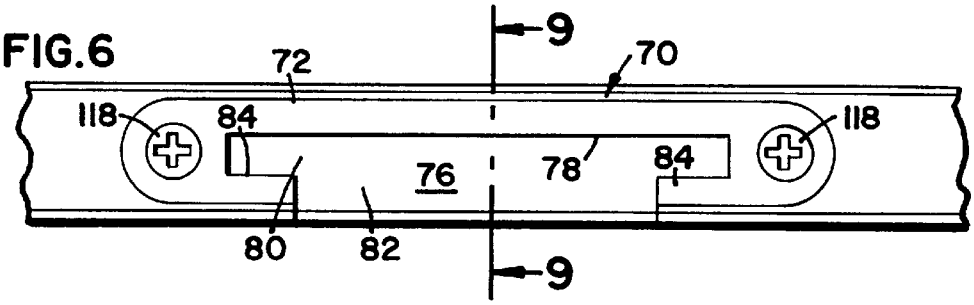
FIG. 6 shows a side elevational view of a second complementary groove element.
Figure 9:
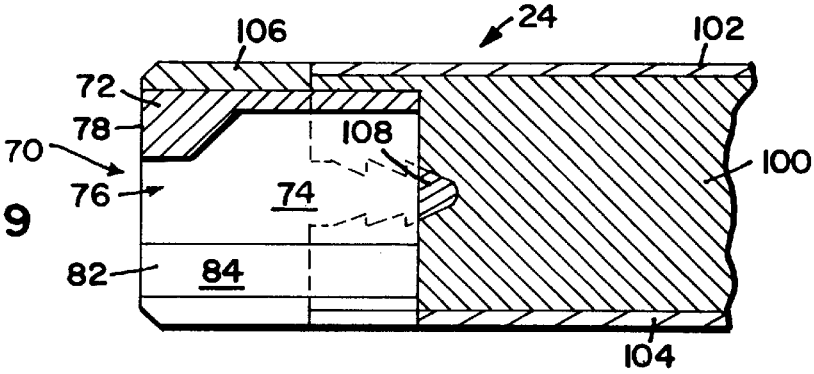
FIG. 9 shows a side sectional view of the second complementary groove element taken along line 9—9 in FIG. 6.

Referring now to FIGS. 6 and 9, there is shown a second groove-type retainer element, generally designated 70. The second groove-type element 70 differs from the first groove-type element 50 in that the recess 74 is open to both the front and bottom without interruption from a cross member. Similar to the first groove-type element 50, the second groove-type element 70 includes a plate member 72 mounting into the side of the floor section 22. The plate member 72 includes a recess 74 with an orifice 76 opening in the side of the groove element 70. As with the first groove-type element 50, the second groove-type element 70 is configured for receiving the tongue elements 40 and 90 from the floor sections and edge trim sections. Upper retainer portion 78 extends downward into recess 74 forming a side opening 76. The recess 74 also opens to below the plate member so that when adjacent panels are fitted together, the groovetype elements 70 may be lowered onto the tongue elements 40, as is required for assembly, as explained hereinafter. The upper retainer element 78 then engages the upper surface of the tongue element 40 to connect and retain the adjacent sides of the panels.

Similar to first groove-type element 50, second groove element 70 includes opening 76 to the side having a widened upper portion 80 and a lower narrow portion 82. Restrictive portions 84 extend inward from each end to form the narrowed portion 82. The plate members 72 are mounted to the panels with bolts or screws 118 or other methods well known in the art.

Referring now to FIG. 12, edge trim section 26 is shown and includes an upper sloping surface 112 and support legs 114 and 116. Tongue elements 90 extend outward from the side of the edge trim section 26 and include a horizontal portion 92 and upward bent portion 94, similar to tongue elements 40. In addition, as shown in FIG. 13, sides of the tongue elements 90 taper inward and the bottom is radiused to facilitate alignment and assembly. The tongue element 90 is additionally supported and held in place by screws, pins or other retainer members 120. It can be appreciated that the edge trim tongue element 90 is wider and thinner than floor panel tongue element 40. With this configuration, the tongue element 90 inserts into the upper widened portions 60 and 80 of the orifices 56 and 76 and supported from below by restrictive portions 64 and 84. The narrower tongue elements 40 of the floor sections insert into the lower narrow portions 62 and 82 of the groove elements 50 and 70. In a preferred embodiment, tongue-type element 90 is 70 mm wide while tongue-type element 40 is 50 mm wide. In addition, it can be appreciated that the tongue-type element 90 is thinner to insert into the upper portions 60 and 80 of the recesses while the tongue element 40 is thicker, extending into the lower portion 62 and 82 of the orifices 56 and 76 intermediate the restrictive portions 64 and 84.

Referring now to FIG. 10, to connect and secure adjacent edges of a first floor section having a groove type element 50 with a second floor section having a tongue element 40, the first section, having the adjacent side with the tongue element 40, is tilted upward. The bent portion 44 of the tongue element 40 is oriented in a substantially horizontal plane and then inserted horizontally into the orifice 56 of the recessed element 50. The floor panel 22 having the tongue element 40 is then tilted further downward and the tongue element 40 is slid further into the recess 54 with the bent portion 44 extending behind retainer portion 58. As shown in FIG. 11, when the tongue element 40 is inserted fully into the recess 54, the angled upper surface of the bent portion 44 of the tongue element 40 engages the rear complementary angled surface of the upper retainer portion 58 of the groove-type element 50. At this position, both panels 22 extend horizontally on a supporting surface and resist separation forces as bent tongue portion 44 engages upper retainer portion 58. To separate the panels 22, the floor panel having the tongue element 40 is tilted upward and the panels can be slid apart as shown in FIG. 10.

In a similar manner, the edge sections 26 having tongue elements include tongue elements 90 which insert into the recess 54. However, the lower portion of the tongue element 90 rests above the restrictive portions 64 so that the tongue element 90 can only insert into the widened portion 60 of the recess 54. The upper bent portion 94 of the tongue element engages the rear complementary angled portion of the retainer portion 58 to prevent horizontal separation of the two floor panels. It can be appreciated that although the above description of placement of a tongue element 90 into an orifice 56 is described for the first groove element 50, the procedure and fit is the same for inserting the tongue element 90 into the second groove element 70.

Since a first side of the attaching floor panel must be pivoted to insert the tongue element 40 into the recess 54, it can be appreciated that the adjacent side of the newly attaching floor panel having groove elements 70 must also engage the tongue elements 40 of the adjacent panel in the same row. However, it is not possible to tilt the panel to two adjacent sides at the same time. Therefore, the groove element 70 having the open bottom can be lowered onto the tongue element 40 so that the upwardly bent portion 44 of the tongue element 40 engages the rear angled surface of the retainer portion 78.

Assembly of the floor system 20 is easy and uncomplicated as the floor panels 22 and 24 have identical positioning of tongue elements 40 and groove-type elements 50 and 70. As shown in FIG. 1, the floor panels 22 and 24 are designated with letters indicating the approximate position of the tongue and groove elements. The approximate position of a tongue element 40 extending from the side of the panels 22 and 24 is indicated by the letter A in FIG. 1. Similarly, the position of the first groovetype elements 50 is indicated by the letter B. Groove-type recessed elements 70 are indicated by the letter C and the tongue elements 90 from the edge trim sections 26 are indicated by the letter D.

Assembly of the floor 20 begins by positioning the first floor panel 22 shown in the uppermost left portion of FIG. 1. The floor panel to the immediate right of the first panel is attached by lowering the recessed elements 70, indicated by letter C, onto the tongue elements 40, indicated by letter A. This process is repeated until the first row of panels is completely formed. In the preferred embodiment, the adjacent rows of panels are staggered so that the full-size panels 22 can interlock with two full size panels 22 in each adjacent row. Therefore, to begin the second row, one half-size panel 24 is placed at the side of the left-most panel 22 from the first row, below the top row as viewed in FIG. 1. The tongue element 40, as indicated at letter A is brought proximate the groove-type recessed element 50, indicated as letter B and the panel 24 is tilted up and the tongue element 40 is inserted into position, as shown in FIGS. 10 and 11. The full-size panel 22 to the right of the half-size panel 24 is similarly placed with the tongue elements A inserting into the groove-type recessed elements indicated at letter B from the first row of the panels. However, as the tongue elements A extending to the right from the half-size panel 24 cannot be pivoted at the same time as the side adjacent the first row of panels, the recessed elements indicated at C must be second groove-type recessed elements 70 having an open bottom so that as the panel is pivoted downward, the tongue element can enter the bottom of the recess 74 and engage the retaining portion 78. This process is repeated with adjacent panels 22 being added to the right until the edge of the floor is reached and another half-size panel 24 is added. The process is repeated with additional rows being added with the full-size panels 22 of the adjacent rows being offset.

When the planar surface of the portable floor 20 has been completed, the edge trim sections 26, 28, 30, 32, 34 and 36 are added to provide a smooth transition to the underlying supporting surface. Where the edges of the planar dance floor have tongue elements 40 extending therefrom as indicated at letters A, edge trim sections 28 are connected by pivoting edge trim sections 28 so that the groove elements 50 slide downward and pivot relative to the tongue elements 40. At the corners, sections 32 and 36, having oppositely 45° angled complementary ends, are similarly positioned and attached.

In a similar manner, edge trim sections 26 having tongue elements 90, indicated by letter D, are connected to the sides of the planar floor surface where recessed elements 50 and 70, indicated by letters B and C are positioned. The sections 26 are tilted at an angle and the tongue elements 90 are inserted into the upper widened portions 60 and 80 of the recesses 54 and 74 in a manner similar to that shown in FIGS. 10 and 11. When inserted, the tongue elements 90 engage the retainer members 58 and 78. Similarly, comer sections 30 and 34, which have oppositely angled 45° complementary comer portions, are attached to the edge of the planar floor surface. The assembled floor 20 includes an extended planar floor surface and a gradual transition from the floor surface to the underlying surface. With the present configuration, as the edge trim sections are stepped on and other forces are applied, greater support is needed below the tongue elements 90. However, it can be appreciated that the restricting portions 64 and 84 provide support from below the tongue elements 90 to hold the edge trim sections 26, 30 and 34 securely in place. In a similar manner, the lower cross-connecting members 66 of the groove elements 50 in edge trim sections 28, 32 and 36 provide support below the tongue elements 40 of the floor sections. In this manner, a secure connection is made between the edge trim elements and the planar floor sections.

It can be appreciated that the floor 20 is also easily disassembled by first removing the edge trim sections. The planar floor is disassembled by removing the last assembled piece and removing the panels in a row-by-row configuration working right to left and then up to the next adjacent row, as viewed in the configuration shown in FIG. 1.

Figure 15:
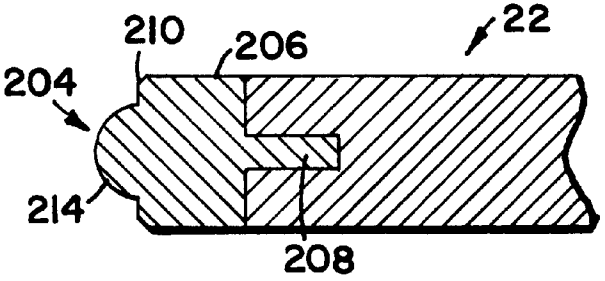
FIG. 15 shows a side sectional view of a second side of the floor panel shown in FIG. 14 having a convex profile portion complementary to the concave portion of the side shown in FIG. 14.
Figure 14:
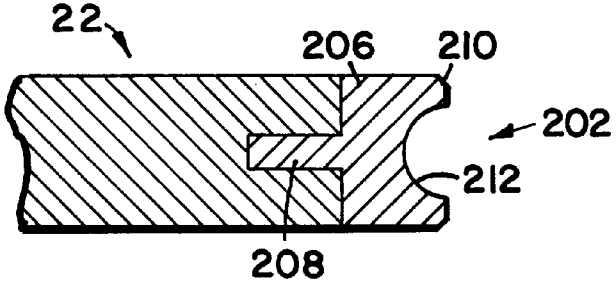
FIG. 14 shows a side sectional view of a second embodiment of a floor panel having a side with a concave profile portion according to the principles of the present invention.
Figure 16:
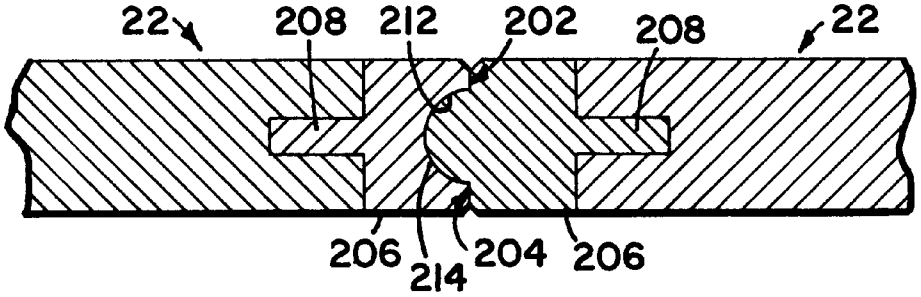
FIG. 16 shows a side sectional view of the floor panels shown in FIGS. 14 and 15 with the adjacent sides attached.
Figure 17:
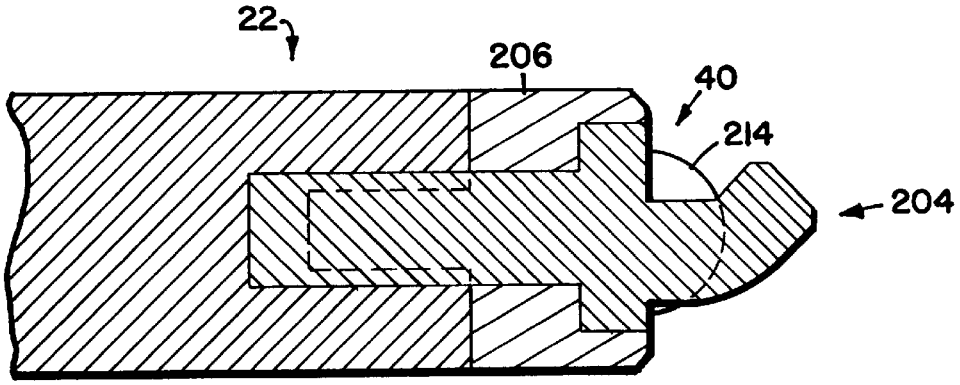
FIG. 17 shows a side sectional view of the side of the floor panel shown in FIG. 15 taken through a tongue connector element.

Referring now to FIGS. 14–16, there is shown a second embodiment of a portable floor system 20. The second embodiment of the portable floor system 20 includes floor panels 22 and half-size panels 24 similar to those described above. However, as shown in FIG. 15, each panel 22 includes a first side 204 which includes a portion having a substantially convex outward arcing profile 214. In addition, at least the upper edge forms a bevel 210. The bevel 210 and the convex portion 214 are formed in the edging material 206 which includes a connecting section 208 extending into the core of the floor panel 22. As shown in FIG. 17, in the same locations as in the first embodiment, tongue members 40 are positioned along the side 204. The side 204 corresponds to the top edge of each of the panels 22, as shown in the top plan view of FIG. 1. In the second embodiment, the tongue-type elements 40 include a mounting plate 220 mounting into the panel edging material 206 and secured with screws 222 at either side of the plate 220, as shown in FIG. 23.

Referring now to FIG. 14, in the second embodiment, each floor panel 22 has other three sides 202 having a concave profile portion 212. The sides 202 correspond to the left, right and lower sides of each panel shown in FIG. 1. The concave portion 212 arcs inwardly and is complementary to and receives the convex profile portion 214, as shown in FIG. 16. When assembled, the edges 202 and 204 abut one another with the convex portion 214 extending into and engaging the concave portion 212. It can be appreciated that the interconnection provides additional alignment and stability along the upper and lower sides of each panel, as viewed in FIG. 1, where an extended seam would otherwise be formed and additional alignment and stability may some times be required.

Figure 18:
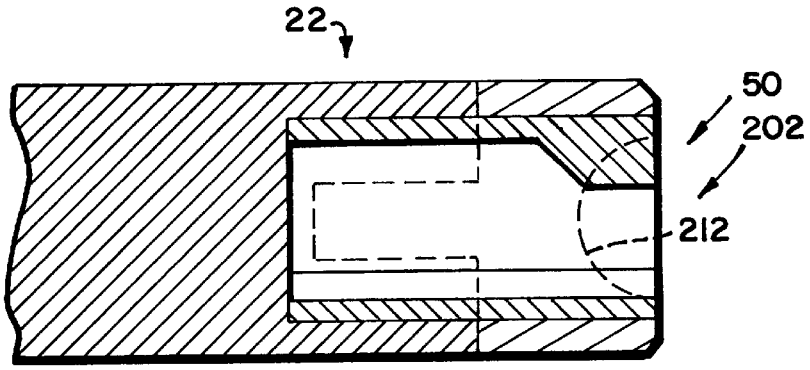
FIG. 18 shows a side sectional view of the side of the floor panel shown in FIG. 14 taken through a first complementary groove element.
Figure 19:
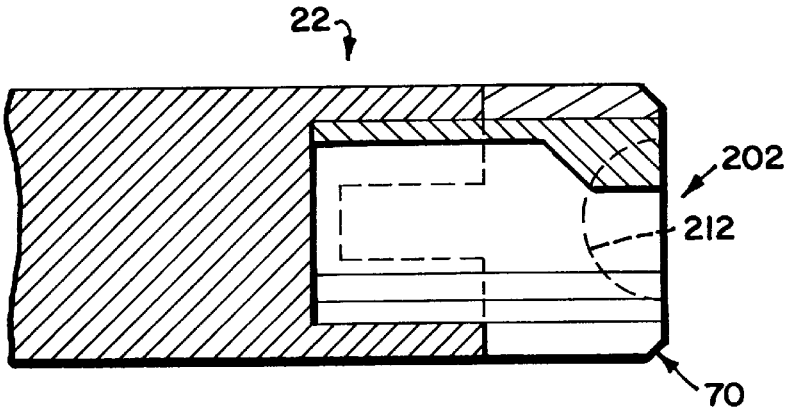
FIG. 19 shows a side sectional view of the side of the floor panel shown in FIG. 14 taken through a second complementary groove element.

Referring to FIGS. 18–19, two of the sides 202 of the panel include groove type members 50 and 70, as previously described hereinabove. The groove type elements 50 and 70 are placed in the same location as in the first embodiment and are flush with the ends of the convex profile, along the edge. It can be appreciated that the tongue and groove elements connect exactly the same as in the first embodiment. In the alignment shown in FIG. 1, the lower sides of the panels 22 and 24 have a concave profile 212 and groove elements 50 and the left sides of the panels have a concave profile 212 and groove elements 70. The right sides of the panels 22 and 24, as the panels are aligned in FIG. 1, have a concave profile 212 and tongue-type elements 40, as shown in FIG. 20. The tongue-type elements 40 mount along a concave profile side 202 in a manner similar to that shown in FIG. 23.

Edge trim panels 226, shown in FIG. 21, include a convex portion 214 which engages the concave portions 212 of the floor panels 22 and provide a smooth transition to the underlying surface, as described above. It can also be appreciated that the edge trim section 226 includes tongue elements 90, as described above. For the alignment shown in FIG. 1, the left and lower edges of the floor 20 would have edge trim panels 226.

Referring to FIG. 22, edge trim section 228 includes concave profile portion 212 which engages the convex profile portion 214 of the floor panels 22. The edge trim sections 228 provide a smooth transition to the underlying floor surface, as described above. The edge trim sections 228 include groove type elements 50 for connecting to tongue elements 40, as explained hereinabove. For the floor alignment shown in FIG. 1, the upper and right edges of the floor 20 would have edge trim panels 228.

Figure 24:
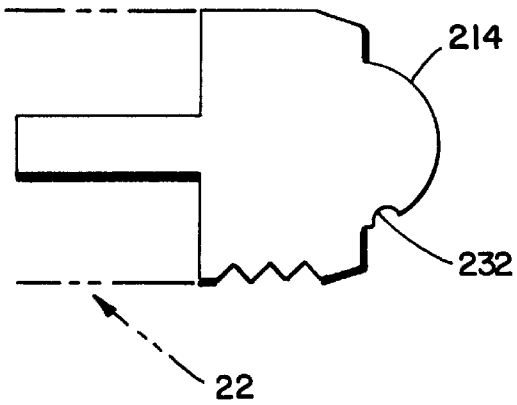
FIG. 24 shows a side elevational view taken of an edge portion of a floor panel having a convex profile and a groove extending along the profile.

Referring now to FIGS. 24–29, there is shown a further embodiment of the present invention. Shown in FIG. 27, the sides of the panels 22 having a concave profile portion 212 may also include a groove 230 extending therein horizontally along the concave profile portion 212. In addition, as shown in FIG. 24, the sides of the panel 22 having a convex profile portion 214 also include a groove 232 formed therein extending horizontally along the lower portion of the convex profile 214. Except for the grooves 230 and 232, the concave profile portions 212 and convex profile portions 214 remain unchanged.

Figure 25:
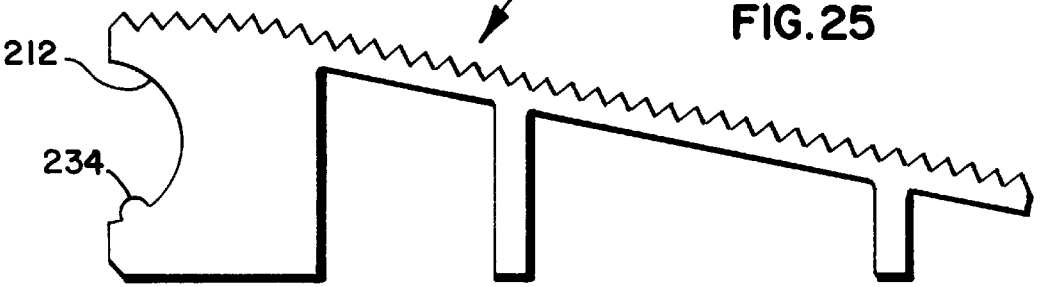
FIG. 25 shows a side elevational view of an edge trim panel having a concave edge profile and a horizontally extending ridge protruding from the concave profile.
Figure 28:
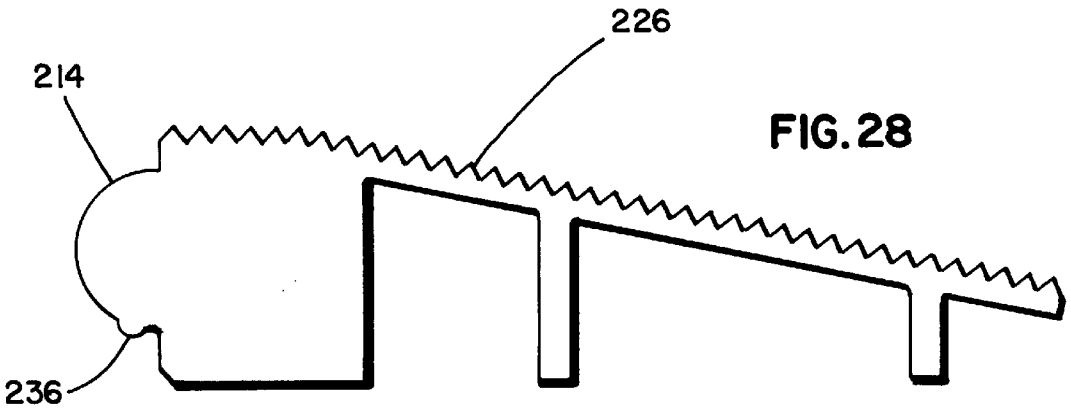
FIG. 28 shows a side elevational view of an edge trim panel having a convex profile and a horizontally extending ridge protruding from the convex profile.
Figure 27:
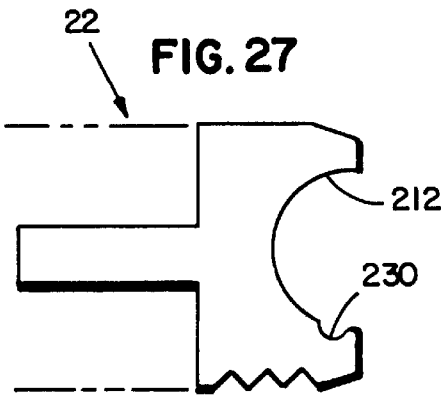
FIG. 27 shows a side elevational view of a floor panel edge portion with a concave side profile and a groove formed in the profile.

Complementary to the edges shown in FIGS. 24 and 27 are edge trim panels shown in FIGS. 25 and 28. Edge trim panel 228, as shown in FIG. 25, includes a concave profile portion 212 which includes a ridge 234 extending horizontally along a lower portion of the inward arcing profile portion 212. The ridges 234 are configured to lock into the grooves 230. Similarly, as shown in FIG. 28, edge trim panel 226 includes a ridge 236 extending horizontally along a lower portion of the convex profile 214. The ridges 236 are configured to seat in the grooves 232.

Figure 26:
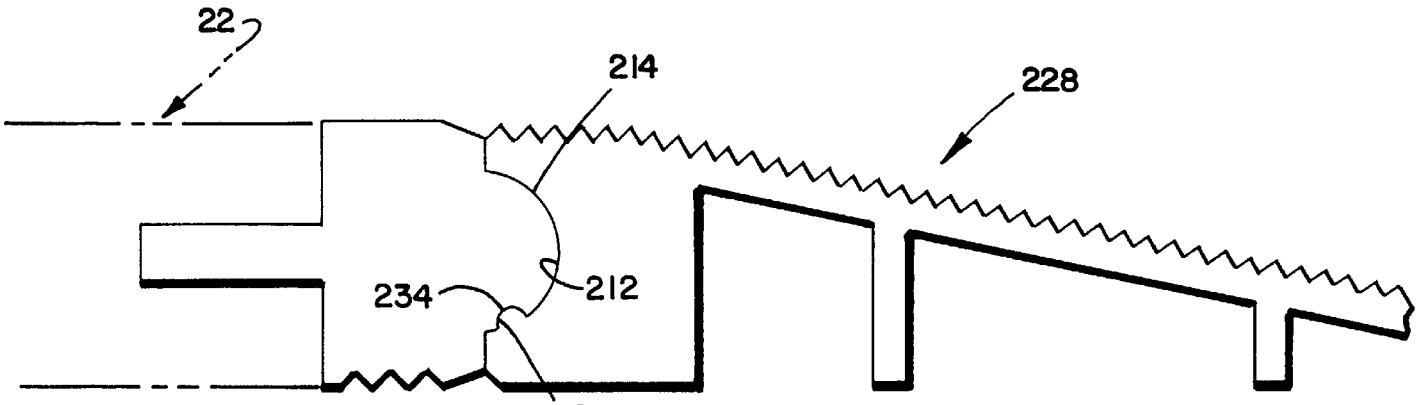
FIG. 26 shows a side sectional view of the floor panel edge portion shown in FIG. 24 connected to the edge trim panel shown in FIG. 25.
Figure 29:
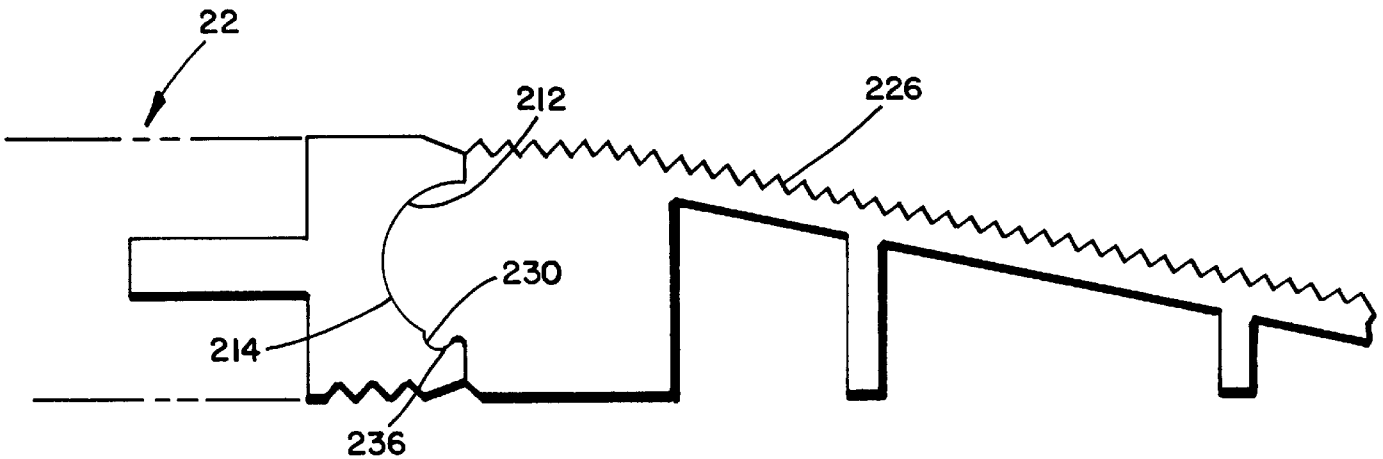
FIG. 29 shows a side elevational view of the floor panel edge portion shown in FIG. 27 attached to the edge trim panel shown in FIG. 28.

When the edge trim panels 226 and 228 are tilted into position as shown in FIG. 10, profiles 212 and 214 will rotate relative to one another until the ridges 234 and 236 are aligned with the grooves 230 and 232 as shown in FIGS. 26 and 29. There is a slight interference fit between the ridges 234 or 236 and the opposing profile portions 212 or 214, so that when the ridges 234 and 236 are aligned with the corresponding grooves 230 and 232, the ridges will snap into place to provide a more secure lock for the narrower edge trim panels which may have more relative movement than the wider panels. Although the ridges 234 and 236 slide relatively easily over the profiles 214 and 212, the ridges 234 and 236 lock into the corresponding grooves 232 and 230. When the ridges 234 and 236 are seated in the grooves 232 and 230, the ridges fill the grooves and are not easily rotated out of engagement with the grooves. It can be appreciated that this configuration requires relatively little force to engage the ridges 234 and 236 and the corresponding grooves 232 and 230, but greater force is required to disengage the ridges 234 and 236 and the grooves 230 and 232. The interaction of the ridges 234 and 236 seating into grooves 230 and 232 prevents the edge trim panels 228 and 226 from moving relative to the edges of the panels 22 and 24 and accidentally unlocking. The ridges 234 and 236 provides multiple locking mechanisms for the edges of the floor panels 22 and 24 and the edge trim panels 226 and 228.

It can be appreciated that ridges 234 and 236 and the grooves 230 and 232 also provide for simple separation as the edge trim panels 226 and 228 can be rotated upward to disengage the grooves 50 from the tongue members 90 as explained above. Once the ridges 234 and 236 and the grooves 232 and 230 have been disengaged, the panels are unlocked. Therefor, when tilted upward, the edge trim panels 226 and 228 may be simply pulled away from the floor panels 22 and 24.

It can be further appreciated that the present invention provides for a lightweight durable construction and easy assembly and disassembly. There are no moving parts and no actuation or tools are required to lock adjacent sections together. Moreover, the floor panels are all configured in the same manner so that the orientation of each panel can be easily identified by workers.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the fill extent indicated by the broad general meaning of the terms in which the appended claims are expressed.

We claim:

1. A planar floor panel for a removable floor system comprising:

a top;

a bottom; and four sides, wherein at least a first side includes a tongue element, a third side includes a complementary first receiver element, and a fourth side includes a complementary second receiver element; and wherein the first receiver element defines a recess extending to the bottom of the panel.

2. The planar floor panel of claim 1, wherein:

the first receiver element is located proximate a bottom edge of the third side and is adapted for receiving a tongue element from below the panel, and for receiving a tongue element from the third side of the panel; and the second receiver element is located proximate a bottom edge of the fourth side and has an opening thereto adapted for receiving a tongue element from the fourth side of the panel.

3. The planar floor panel of claim 1, wherein:

a first side includes a tongue element;

a second side, adjacent to the first side, includes a tongue element;

a third side, adjacent the second side, includes a receiver element having a side opening adapted for engaging a tongue element from the side; and a fourth side, adjacent the first side and third side, includes the first receiver element adapted for engaging a tongue element inserting from either the bottom or the side of the panel.

4. The planar floor panel of claim 2, wherein the opening in each of the receiver elements includes a restricting portion extending horizontally partially into the opening along a bottom edge of the opening, wherein a lower portion of the opening is narrower than an upper portion of the opening.

5. A planar floor panel for a removable floor system comprising:

a top;

a bottom; and four sides, wherein at least a first side includes a tongue element, a third side included a complementary first receiver element, and a fourth side includes a complementary second receiver element; wherein each of the first and second receiver elements includes an opening adapted for receiving one of the tongue elements proximate the side of the floor panel; the opening including a restricting member extending into the opening along the bottom edge of the opening, wherein the width of the lower portion of the opening is reduced.

6. The planar floor panel of claim 1, wherein each of the tongue elements comprises a rigid member including a first end proximate a side of the panel, and a second distal end extending angularly upward from the first end.

7. A planar floor panel for a removable floor system comprising:

a top;

a bottom; and four sides, wherein at least a first side includes a tongue element, a third side includes a complementary receiver element, and a fourth side includes a complementary receiver element; wherein each of the tongue elements includes a first end proximate a side of the panel, and a second distal end narrower than the first end.

8. A floor system comprising:

at least two substantially planar panels, wherein each panel has a top, a bottom, and four sides;

a tongue element secured to a first side of each panel;

a receiving element secured to a second side of each panel, said receiving element adapted for receiving the tongue element; wherein the panels are removably connected by securing the tongue element of a first panel into the receiving element of a second panel; and comprising removable edge sections having an angled upper surface and at least one tongue element.

9. The floor system of claim 8, further comprising removable edge sections having an angled upper surface and at least one receiver element.

10. A floor system comprising:

at least two substantially planar panels, wherein each panel has a top, a bottom, and four sides;

a tongue element secured to a first side of each panel;

a receiving element secured to a second side of each panel, said receiving element adapted for receiving the tongue element; wherein the panels are removably connected by securing the tongue element of a first panel into the receiving element of a second panel;

removable edge sections having at least one tongue element; wherein the tongue elements on the removable edge sections are wider than the tongue elements on the planar panels.

11. A floor system comprising:

at least two substantially planar panels, wherein each panel has a top, a bottom, and four sides;

a tongue element secured to a first side of each panel;

a receiving element secured to a second side of each panel, said receiving element adapted for receiving the tongue element; wherein the panels are removably connected by securing the tongue element of a first panel into the receiving element of a second panel;

wherein the tongue elements narrow from an end proximate the side of the flooring panels to a distal end.

12. A floor system comprising:

at least two substantially planar panels, wherein each panel has a top, a bottom, and four sides;

a tongue element secured to a first side of each panel; and a receiving element secured to a second side of each panel, said receiving element adapted for receiving the tongue element; wherein the panels are removably connected by securing the tongue element of a first panel into the receiving element of a second panel;

removable edge sections having at least one tongue element; wherein the receiving elements include side openings having a widened upper portion and a narrow lower portion, and wherein the tongue elements on the floor panels are narrower than a lower portion of the opening in the receiving elements; and the tongue elements on the edge sections are narrower than the upper portion of the opening in the receiving elements and wider than the lower portion of the opening in the receiving elements.

13. A method for installing a removable floor system, comprising the steps of:

placing a first panel, wherein the first panel has a first side having a rigid tongue element, and a second side, adjacent to the first side, having a receiver element having an opening extending to the side of the panel;

securing a first side of a second panel to the first side of the first panel, wherein the second panel has a first side including a receiver element, and a second side adjacent to the first side includes a receiver element having an opening extending to the side of the panel;

securing a first side of a third panel to the second side of the first panel, wherein the third panel has a first side including a tongue element, and a second side adjacent to the first side including a tongue element;

securing a first side of a fourth panel to the second side of the second panel, wherein the first side of the fourth panel includes a tongue element; and securing a second side of the fourth panel to the second side of the third panel, wherein the second side of the fourth panel includes a receiver element having an opening extending to the bottom of the panel for receiving a tongue element from below.

14. A floor system comprising:

at least two substantially planar panels, wherein each panel has a top surface, a bottom surface spaced apart from the top surface, and four sides defining a panel body;

a rigid tongue element secured to a first side of each panel and having a first end proximate a side of the panel extending into the panel body spaced apart from the bottom surface, and a second distal end extending upward from the first end;

a receiving element secured to an other side of each panel, said receiving element is adapted for receiving the rigid tongue element; wherein the panels are removably connected by securing the rigid tongue element of a first panel into the receiving element of a second panel.

15. The floor system of claim 14, wherein the receiving element comprises a first receiving element defining a recess extending to the bottom of the panel.

16. The floor system of claim 15, further comprising a second receiving element at a third side of the panel, the second receiving element defining a recess extending to the third side of the panel.

17. The floor system of claim 16, wherein the second element includes a bar portion extending along a lower edge of the recess proximate the third side of the panel.

18. A method of assembling rectangular floor panels, each of the panels having at least a first side with tongue elements, and at least one second side proximate the first side and having a receiving element, the receiving element defining a recess along a bottom edge of the second side extending to the bottom of the panel, the method comprising the steps of:

attaching a plurality of floor panels in edge to edge relationship by inserting the tongue element of one panel into the receiving element of an abutting panel to form a floor assembly;

attaching a next panel to the floor assembly by inserting a tongue element of the next panel into the receiving element of one the panels of the floor assembly by pivoting about an axis extending along adjoining edges of the next panel and one of the panels of the floor assembly;

lowering the next panel such that the second side of the next panel drops onto a first side of an adjacent panel of the floor assembly, whereby the receiving element of the next panel drops onto and engages the tongue element of the adjacent panel.

19. A method according to claim 18, wherein the first side and the second side are adjoining sides.

* * * * *